US008899019B2

(12) United States Patent
Onoe et al.

(10) Patent No.: US 8,899,019 B2
(45) Date of Patent: Dec. 2, 2014

(54) AIR-FUEL RATIO CONTROL APPARATUS

(75) Inventors: Ryota Onoe, Susono (JP); Junichi Suzuki, Susono (JP); Takahiko Fujiwara, Susono (JP); Makoto Tomimatsu, Susono (JP); Koichi Kimura, Numazu (JP); Shuntaro Okazaki, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 26 days.

(21) Appl. No.: 13/823,398

(22) PCT Filed: Sep. 15, 2010

(86) PCT No.: PCT/JP2010/065916

§ 371 (c)(1),
(2), (4) Date: Jun. 27, 2013

(87) PCT Pub. No.: WO2012/035622

PCT Pub. Date: Mar. 22, 2012

(65) Prior Publication Data

US 2013/0269324 A1 Oct. 17, 2013

(51) Int. Cl.

| | |
|---|---|
| ***F01N 3/00*** | (2006.01) |
| ***F01N 3/10*** | (2006.01) |
| ***F02D 41/14*** | (2006.01) |
| ***F02D 41/02*** | (2006.01) |
| *F02D 41/04* | (2006.01) |

(52) U.S. Cl.

CPC ..... *F02D 41/0235* (2013.01); *F02D 41/1401* (2013.01); *F02D 41/1456* (2013.01); *F02D 41/1441* (2013.01); *F02D 41/045* (2013.01); *F02D 41/1454* (2013.01)

USPC ..... 60/285; 60/276; 60/299

(58) Field of Classification Search

USPC ..... 60/276, 285, 299, 301

See application file for complete search history.

(56) References Cited

U.S. PATENT DOCUMENTS

| | | | | |
|---|---|---|---|---|
| 4,729,219 | A * | 3/1988 | Kayanuma et al. | 60/274 |
| 2007/0220863 | A1 | 9/2007 | Iida et al. | |
| 2008/0072884 | A1 | 3/2008 | Okazaki | |

FOREIGN PATENT DOCUMENTS

| | | |
|---|---|---|
| EP | 1 167 726 A2 | 6/2001 |
| JP | A-63-295831 | 12/1988 |
| JP | A 6-317204 | 11/1994 |
| JP | A 8-189399 | 7/1996 |
| JP | A-11-257133 | 9/1999 |
| JP | A-2001-152913 | 6/2001 |
| JP | A-2003-42002 | 2/2003 |
| JP | A 2003-314334 | 11/2003 |
| JP | A 2004-183585 | 7/2004 |
| JP | A 2005-76496 | 3/2005 |
| JP | A 2005-273524 | 10/2005 |
| JP | A 2007-56755 | 3/2007 |
| JP | A 2007-239698 | 9/2007 |
| JP | A-2007-255336 | 10/2007 |
| JP | A-2009-2170 | 1/2009 |

* cited by examiner

*Primary Examiner* — Audrey K Bradley
(74) *Attorney, Agent, or Firm* — Oliff PLC

(57) ABSTRACT

An air-fuel ratio control apparatus of the present invention includes a determination section and a reverse direction correction introducing section. The determination section determines whether or not an output of the downstream air-fuel ratio sensor falls within a predetermined range whose center corresponds to a target value corresponding to the stoichiometric air-fuel ratio. When the output of the downstream air-fuel ratio sensor falls within the predetermined range, the reverse direction correction introducing section temporarily introduces, to an air-fuel ratio correction in a direction requested by the output, an air-fuel ratio correction in a direction opposite to the requested direction.

16 Claims, 8 Drawing Sheets

AIR-FUEL RATIO CONTROL APPARATUS

TECHNICAL FIELD

The present invention relates to an air-fuel ratio control apparatus (an apparatus for controlling an air-fuel ratio of an internal combustion engine).

BACKGROUND ART

As an apparatus of such a type, there has been widely known an apparatus for controlling an air-fuel ratio of an internal combustion engine on the basis of the outputs from an upstream air-fuel ratio sensor and a downstream air-fuel ratio sensor provided in an exhaust passage (refer to, for example, Japanese Patent Application Laid-Open (kokai) Nos. Hei 6-317204, 2003-314334, 2004-183585, 2005-273524, etc.). The upstream air-fuel ratio sensor is disposed upstream of an exhaust purification catalyst for purifying an exhaust gas discharged from cylinders of the engine (the furthest upstream exhaust purification catalyst when two or more exhaust purification catalysts are provided) with respect to the flow direction of the exhaust gas. The downstream air-fuel ratio sensor is disposed downstream of the exhaust purification catalyst with respect to the flow direction of the exhaust gas.

As the above-described downstream air-fuel ratio sensor of such an apparatus, there is widely used a so-called oxygen sensor (also referred to as an $O_2$ sensor) which exhibits a stepwise response in the vicinity of the stoichiometric air-fuel ratio (Z-characteristic: a characteristic in which the output of the sensor changes stepwise in such a manner that it changes suddenly when the air-fuel ratio changes between the rich and lean sides with respect to the stoichiometric air-fuel ratio). Meanwhile, as the above-described upstream air-fuel ratio sensor, there is widely used the-above described oxygen sensor or a so-called A/F sensor (also referred to as a linear $O_2$ sensor) whose output changes in proportion to the air-fuel ratio.

In such an apparatus, the fuel injection amount is feedback-controlled on the basis of the output signal from the upstream air-fuel ratio sensor such that the air-fuel ratio of the exhaust gas flowing into the exhaust purification catalyst becomes equal to (coincides with) a target air-fuel ratio (hereinafter, this control will be referred to as a "main feedback control"). In addition to the main feedback control, the output signal from the downstream air-fuel ratio sensor is used for a control for feeding back to the fuel injection amount (hereinafter, this control will be referred to as a "sub-feedback control").

Specifically, in the main feedback control, a feedback correction amount is calculated in accordance with a difference between the air-fuel ratio of the exhaust gas (exhaust air-fuel ratio) corresponding to the output from the upstream air-fuel ratio sensor and the target air-fuel ratio. Meanwhile, in the sub-feedback control, a sub-feedback amount (sub-feedback correction amount) is calculated on the basis of the output signal from the downstream air-fuel ratio sensor. By means of feeding the sub-feedback amount back to the main feedback control, the difference between the exhaust air-fuel ratio corresponding to the output from the upstream air-fuel ratio sensor and the target air-fuel ratio is compensated.

Incidentally, as the above-described exhaust purification catalyst, there is widely used a three-way catalyst which can simultaneously remove from exhaust gas unburned substances, such as carbon monoxide (CO) and hydrocarbon (HC), and nitrogen oxide (NOx). Such a three-way catalyst has a function referred to as an oxygen occlusion function or an oxygen storage function. With this function, (1) in a case where the air-fuel ratio of the air-fuel mixture is on the lean side, nitrogen oxide contained in the exhaust gas is reduced through removal of oxygen therefrom and the removed oxygen is occluded (stored) in the three-way catalyst; and (2) in a case where the air-fuel ratio of the air-fuel mixture is on the rich side, the stored oxygen is released so as to oxidize the unburned substances contained in the exhaust gas.

The above-described oxygen storage function (i.e., an ability to purify exhaust gas) of such a three-way catalyst can be maintained at a high level by activating a catalytic material (noble metal) through repetitive storage and release of oxygen. In view of the above, there is known a technology (perturbation control) to forcibly oscillate/fluctuate the air-fuel ratio of the exhaust gas (i.e., the air-fuel ratio of the air-fuel mixture) so as to cause the three-way catalyst to store and release oxygen repeatedly in such an apparatus (refer to, for example, Japanese Patent Application Laid-Open (kokai) Nos. Hei 8-189399, 2001-152913, 2005-76496, 2007-239698, 2007-56755, 2009-2170, etc.).

SUMMARY OF THE INVENTION

In an apparatus of such a type, by means of maximally utilizing the oxygen storage function of the three-way catalyst, the exhaust gas can be purified efficiently (refer to Japanese Patent Application Laid-Open (kokai) No. 2000-4930). In addition, by means of suppressing a sharp change in the output of the downstream air-fuel ratio sensor to a possible extent, emissions can be suppressed. Moreover, if the above-described air-fuel ratio forced oscillation control is not performed at proper period, there is a possibility that the emissions will become even worse. In terms of these points, the conventional apparatuses of such a type still have a room for improvement.

<Configuration>

An air-fuel ratio control apparatus of the present invention is configured in such a manner that an air-fuel ratio of an internal combustion engine is controlled on the basis of outputs of an upstream air-fuel ratio sensor and a downstream air-fuel ratio sensor provided in an exhaust passage. The upstream air-fuel ratio sensor is disposed/provided upstream, with respect to the exhaust gas flow direction, of an exhaust purification catalyst for purifying an exhaust gas discharged from cylinders. The downstream air-fuel ratio sensor is disposed/provided downstream of the exhaust purification catalyst with respect to the exhaust gas flow direction. As such a downstream air-fuel ratio sensor, there can be used an electromotive-force-type (oxygen-concentration electromotive-force-type or concentration-cell-type) oxygen concentration sensor which exhibits a stepwise response near (in the vicinity of) the stoichiometric air-fuel ratio.

The present invention is characterized in that the air-fuel ratio control apparatus includes:

a determination section configured so as to determine whether or not the output of the downstream air-fuel ratio sensor falls within a predetermined range (smaller than the amplitude of the output) whose center corresponds to a target value corresponding to the stoichiometric air-fuel ratio; and a reverse direction correction introducing section, operable when the output of the downstream air-fuel ratio sensor falls within the predetermined range, configured so as to temporarily introduce an air-fuel ratio correction (hereinafter, referred to as a "reverse direction correction") in a direction opposite to a direction (hereinafter, referred to as the "forward direction correction") of an air-fuel ratio correction requested by the output.

Specifically, for example, the reverse direction correction introducing section may be configured so as to introduce, as the reverse direction correction, (an operation of imparting) a rich spike to the air-fuel ratio of the engine in a case where the output of the downstream air-fuel ratio sensor shifts to the rich side, and thus, when the forward direction correction is requested to be performed in a lean direction, and so as to introduce, as the reverse direction correction, (an operation of imparting) a lean spike to the air-fuel ratio of the engine in the case where the output of the downstream air-fuel ratio sensor shifts to the lean side, and thus, when the forward direction correction is requested to be performed in a rich direction. Notably, the reverse direction correction may be introduced more than once per one operation of the forward direction correction.

The reverse direction correction introducing section may be configured so as to prohibit the introduction of the reverse direction correction until a predetermined period of time elapses after a change of the output of the downstream air-fuel ratio sensor between the rich and lean sides (even when the output falls within the predetermined range), and the introduction of the reverse direction correction is implemented after a lapse of the predetermined period of time. That is, the reverse direction correction introducing section may be configured so as to implement the introduction of the reverse direction correction in a case where the predetermined period of time has elapsed after a start of the forward direction correction in a certain direction and the output of the downstream air-fuel ratio sensor falls within the predetermined range.

Moreover, the reverse direction correction introducing section may be configured so as to restrict (specifically, prohibit or reduce in spike quantity) the introduction of the reverse direction correction in a case of a sudden (abrupt) acceleration or a sudden (abrupt) deceleration.

In addition, the air-fuel ratio control apparatus may include a range changing section configured so as to change the predetermined range depending on an operating state of the internal combustion engine (specifically, a temperature and an intake air flow rate).

Action and Effects

In the air-fuel ratio control apparatus of the present invention, which is configured as mentioned above, the downstream air-fuel ratio sensor produces an output representing the oxygen concentration of the exhaust gas discharged (flowed) from the above-described exhaust purification catalyst. When an exhaust gas flows into the exhaust purification catalyst, the oxygen storage/release reaction starts from an upstream end side (the front end side or the exhaust gas inflow side) with respect to the exhaust gas flow direction, and the portion (or region) where the reaction takes place moves toward a downstream end side (the rear end side or the exhaust gas outflow side).

When the oxygen storage or release reaction becomes saturated over the entire exhaust purification catalyst (i.e., from the upstream end to the downstream end), and therefore, the exhaust gas cannot be treated any further, the exhaust gas flows through the exhaust purification catalyst without being treated. In this case, generally, the oxygen concentration of the exhaust gas reaching the downstream air-fuel ratio sensor sharply changes, whereby the output of the downstream air-fuel ratio sensor also sharply changes.

In contrast, in the air-fuel ratio control apparatus of the present invention, in the case where the output of the downstream air-fuel ratio sensor falls within the predetermined range, the reverse direction correction is introduced. Thus, the change of the output of the downstream air-fuel ratio sensor, which is caused as a result of the forward direction correction, is moderated (rendered mild), and inadvertent worsening of exhaust emissions can be suppressed excellently.

More specifically, in the case where the output of the downstream air-fuel ratio sensor falls outside the predetermined range (i.e., when the output is in the vicinity of the maximum value on the rich or lean side), oxygen storage or release has almost been saturated in the exhaust purification catalyst. Accordingly, in this case, the forward direction correction is performed as usual without introducing the reverse direction correction. As a result, the exhaust gas produced as a result of the forward direction correction flows into the exhaust purification catalyst, whereby oxygen is stored or released at the upstream end side of the exhaust purification catalyst with respect to the exhaust gas flow direction. Thus, the above-described saturated state is eliminated, thereby allowing treatment of the exhaust gas produced as a result of the reverse direction correction subsequently performed. Accordingly, there is satisfactorily suppressed worsening of exhaust emissions, which is caused by the introduction of the reverse direction correction.

When the reverse direction correction is introduced, in the exhaust purification catalyst, while the exhaust gas produced as a result of the reverse direction correction is purified appropriately in the upstream portion of the exhaust purification catalyst with respect to the exhaust flow direction, the oxygen storage or release reaction caused by the forward direction correction gradually progresses in the middle and downstream portions. This moderates the changes in the oxygen concentration of the exhaust gas in the middle and downstream portions, the changes being caused by the forward direction correction, to thereby moderate (render mild) the change caused by the forward direction correction in the output of the downstream air-fuel ratio sensor. Moreover, by means of introducing the reverse direction correction when the output of the downstream air-fuel ratio sensor is within the predetermined range in which the output changes (relatively) sharply with respect to the air-fuel ratio, a sharp change in the output of the downstream air-fuel ratio sensor can be suppressed satisfactorily.

In addition, in the air-fuel ratio control apparatus of the present invention, by means of maximally utilizing the oxygen storage function of the exhaust purification catalyst, the exhaust gas can be purified more efficiently. A possible reason for this is as follows.

Specifically, for example, when the output of the downstream air-fuel ratio sensor changes from the rich side to the lean side, the forward direction correction in the rich direction is requested. At this point in time when the output changes from the rich side to the lean side, oxygen storage has become completely saturated in the exhaust purification catalyst.

When the forward direction correction in the rich direction is started, the exhaust gas flowing into the exhaust purification catalyst becomes rich. As a result, in the exhaust purification catalyst, stored oxygen is released so as to oxidize the unburned substances contained in the exhaust gas whose air-fuel ratio is on the rich side. Such oxygen release (i.e., reduction) starts from the upstream end side of the exhaust purification catalyst with respect to the exhaust flow direction. As oxygen release becomes saturated on the upstream side with respect to the exhaust flow direction, the portion where the oxygen release takes place moves toward the downstream side.

In the present invention, in the case where the output of the downstream air-fuel ratio sensor falls within the predetermined range, the reverse direction correction in the lean direction is temporally introduced (e.g., as a lean spike imparting operation), the correction direction of the reverse direction correction being opposite to that of the forward direction correction by the rich request on the basis of the output of the downstream air-fuel ratio sensor. Thus, in the upstream portion (upstream end portion) of the exhaust purification catalyst with respect to the exhaust flow direction, the temporarily introduced exhaust gas whose air-fuel ratio is on the lean side is purified and oxygen is occluded/stored. Meanwhile, since the average air-fuel ratio of the exhaust gas is still on the rich side, the portion or region where oxygen release takes place gradually moves toward the downstream side of the exhaust purification catalyst with respect to the exhaust flow direction. Accordingly, in the exhaust purification catalyst, while the exhaust gas produced as a result of the reverse direction correction is treated appropriately in the upstream portion with respect to the exhaust flow direction, the oxygen release ability in the middle and downstream portions of the exhaust purification catalyst is fully utilized.

Even in the case where the output of the downstream air-fuel ratio sensor falls within the predetermined range, the oxygen storage or release in the exhaust purification catalyst is almost saturated before the predetermined period of time lapses after the change of the output of the downstream air-fuel ratio sensor between the lean and rich sides. Therefore, by means of prohibiting the introduction of the reverse direction correction before the lapse of the predetermined period of time, and introducing the reverse direction correction after the lapse of the predetermined period of time, there can be satisfactorily suppressed worsening of exhaust emissions, which is caused by the introduction of the reverse connection.

In the case of sudden/abrupt acceleration or sudden/abrupt deceleration, a large disturbance occurs in the air-fuel ratio of exhaust gas. In this case, by means of restricting the introduction of the reverse direction correction (by means of prohibiting it or reducing the spike quantity), there can be satisfactorily suppressed worsening of exhaust emissions, which is caused by the introduction of the reverse direction correction.

The output characteristic of the downstream air-fuel ratio sensor changes depending on the operating state of the internal combustion engine. Specifically, the amplitude of the output voltage of the downstream air-fuel ratio sensor—which is determined by using a reference voltage (corresponding to the target value) corresponding to the stoichiometric air-fuel ratio as the center value—becomes smaller as its temperature becomes higher. Meanwhile, the amplitude of the output voltage of the downstream air-fuel ratio sensor becomes smaller as the intake air flow rate becomes larger. In view of the above, by means of changing the predetermined range in accordance with the operating state of the internal combustion engine, the air-fuel ratio can be controlled more satisfactorily.

As mentioned above, according to the present invention, the change in the output of the downstream air-fuel ratio sensor which is caused by the forward direction correction is moderated (rendered mild), and an inadvertent worsening of exhaust emissions is suppressed satisfactorily. In addition, according to the present invention, by means of maximally utilizing the oxygen storage function of the exhaust purification catalyst, the exhaust gas can be purified more efficiently.

DESCRIPTION OF EMBODIMENTS

Hereinafter, an embodiment of the present invention will be described with reference to the drawings. Notably, the following description of the embodiment merely describes a specific example of the present invention specifically to a possible extent so as to satisfy requirements regarding a specification (requirement regarding description and requirement regarding practicability) required under the law.

Therefore, as described below, the present invention is not limited to the specific structure of the embodiment which will be described below. Various modifications of the present embodiment are described together at the end of the specification, because understanding of the consistent description of the embodiment is hindered if such modifications are inserted into the description of the embodiment.

<System Configuration>

Figure 1:
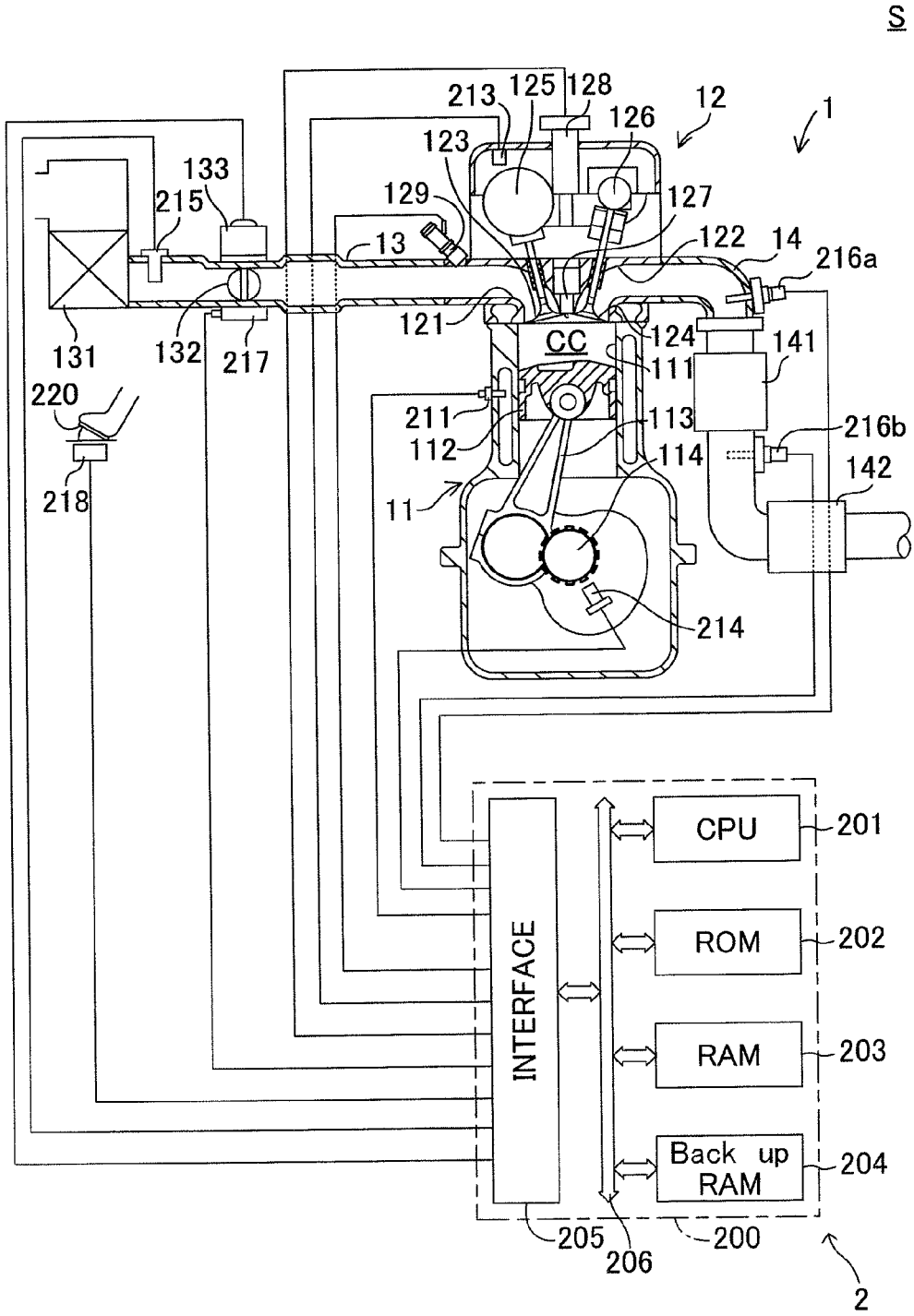
FIG. 1 is a schematic diagram showing an overall configuration of an internal combustion engine system to which an embodiment of the present invention is applied.

FIG. 1 is a schematic diagram showing the configuration of a system S (a vehicle) which includes a spark-ignition multi-cylinder 4-cycle engine of a piston reciprocation type 1 (hereinafter, simply referred to as the "engine 1") to which the present invention is applied; and an engine controller 2 which is one embodiment of the air-fuel ratio control apparatus of the present invention. Notably, FIG. 1 shows a cross sectional view of a specific cylinder of the engine 1, taken orthogonal to a cylinder arrangement direction (it is assumed that the structures of the remaining cylinders are identical to that of the specific cylinder).

<<Engine>>

As shown in FIG. 1, the engine 1 includes a cylinder block 11 and a cylinder head 12. The cylinder head 12 is joined to one end (the upper end in FIG. 1) of the cylinder block 11. The cylinder block 11 and the cylinder head 12 are secured to each other with unillustrated bolts, etc. An intake passage 13 and an exhaust passage 14 are connected to the engine 1.

Cylinders 111, which are generally cylindrical through-holes, are formed in the cylinder block 11. As described above, the cylinders 111 are disposed in a line (along the cylinder arrangement direction) in the cylinder block 11. A piston 112 is accommodated within each cylinder 111 such that the piston 112 can reciprocate along the center axis of the cylinder 111 (hereinafter, referred to as the "cylinder center axis").

In the cylinder block 11, a crankshaft 113 is disposed in parallel with the cylinder arrangement direction, and is rotatably supported. The crankshaft 113 is connected to each piston 112 via a corresponding connecting rod 114 such that it is rotated as a result of the reciprocating motion of the pistons 112 along the cylinder center axis.

A plurality of recesses are provided on an end surface of the cylinder head 12, whose surface faces the cylinder block 11, at positions corresponding to the cylinders 111. That is, when the cylinder head 12 is fixedly joined to the cylinder block 11, a combustion chamber CC is formed by a space within each cylinder 111 above the top surface of the piston 112 (on the side toward the cylinder head 12 (the upper side in FIG. 1)) and a space within a corresponding one of the above-described recesses.

An intake port 121 and an exhaust port 122 are formed in the cylinder head 12 so as to communicate with the combustion chamber CC. An intake passage 13 including an intake manifold, a surge tank, etc. is connected to the intake port 121. Similarly, an exhaust passage 14 including an exhaust manifold is connected to the exhaust port 122.

Also, intake valves 123, exhaust valves 124, an intake valve control apparatus 125, an exhaust cam shaft 126, spark plugs 127, igniters 128, and injectors 129 are attached to the cylinder head 12.

The intake valve 123 is a valve for opening or closing the intake port 121 (i.e., for controlling the communication between the intake port 121 and the combustion chamber CC). The exhaust valve 124 is a valve for opening or closing the exhaust port 122 (i.e., for controlling the communication between the exhaust port 122 and the combustion chamber CC).

The intake valve control apparatus 125 has a mechanism for controlling the rotational angles (phase angles) of unillustrated intake cams and an unillustrated intake cam shaft. The intake valve control apparatus 125 is configured such that it can change the valve open timing (intake valve open timing) VT of the intake valve 123, while fixing the valve open period of the intake valve 123 (the width of a crank angle range in which the valve is opened). Since the specific configuration of such an intake valve control apparatus 125 is well known, in the present specification, its description will not be provided. The exhaust cam shaft 126 is configured so as to drive the exhaust valve 124.

The ignition plug 127 is provided such that a spark generation electrode provided at the forward end thereof is exposed to the interior space of the combustion chamber CC. The igniter 128 includes an ignition coil for generating a high voltage to be applied to the ignition plug 127. The injector 129 is configured and disposed so as to inject into the intake port 121 a fuel to be supplied to the combustion chamber CC.

<<Intake and Exhaust Passages>>

A throttle valve 132 is provided in the intake passage 13 at a position between an air filter 131 and the intake port 121 so as to change the opening cross-sectional area of the intake passage 13. This throttle valve 132 is rotated by a throttle valve actuator 133 composed of a DC motor.

An upstream catalytic converter 141 and a downstream catalytic converter 142 are provided in the exhaust passage 14. The upstream catalytic converter 141, which corresponds to the "exhaust purification catalyst" of the present invention, is an exhaust purification catalyst apparatus into which the exhaust gas discharged from the combustion chamber CC to the exhaust port 122 flows first, and is disposed upstream of the downstream catalytic converter 142 with respect to the flow direction of the exhaust gas. Each of the upstream catalytic converter 141 and the downstream catalytic converter 142 includes a three-way catalyst having an oxygen storage function, and is configured to simultaneously remove from exhaust gas unburned substances such as carbon monoxide (CO) and hydrocarbon (HC) and nitrogen oxide (NOx).

<<Controller>>

An engine controller 2 includes an electronic control unit 200 (hereinafter, referred to as the "ECU 200"), which constitutes various sections/means of the present invention such as a determination section and a reverse direction correction introducing section. The ECU 200 includes a CPU 201, a ROM 202, a RAM 203, a backup RAM 204, an interface 205, and a bi-directional bus 206. The CPU 201, the ROM 202, the RAM 203, the backup RAM 204, and the interface 205 are connected together by the bi-directional bus 206.

The ROM 202 stores previously stored routines (programs) to be executed by the CPU 201, tables (including lookup tables and maps) which are referred to when the CPU 201 executes the routines, etc. The RAM 203 temporarily stores data, if necessary, when the CPU 201 executes the routines.

The backup RAM 204 stores data when the CPU 201 executes the routines in a state where the power is on, and retains the stored data even after the power is cut off. Specifically, the backup RAM 204 stores a portion of the obtained (detected or estimated) engine operation parameters, the results of correction (learning) of the above-described tables, etc. such that they can be overwritten.

The interface 205 is electrically connected to various sensors to be described later and to operating sections such as the intake valve control apparatus 125, the igniter 128, the injector 129, the throttle valve actuator 133, etc. The interface 205 transmits detection signals from the various sensors to the CPU 201, and transmits to the operating sections drive signals which are output from the CPU 201 so as to drive the operating sections.

In this manner, the engine controller 2 is configured so as to receive detection signals from the various sensors to be described later via the interface 205, and transmit the above-described drive signals to the respective operating sections on the basis of results of computation performed by the CPU 201 based on the detection signals.

<<Various Sensors>>

The system S includes a cooling-water temperature sensor 211, a cam position sensor 213, a crank position sensor 214, an air flow meter 215, an upstream air-fuel ratio sensor **216*a*, a downstream air-fuel ratio sensor 216*b*, a throttle position sensor 217, an accelerator opening sensor 218**, etc.

The cooling-water temperature sensor 211 is attached to the cylinder block 11. The cooling-water temperature sensor 211 is configured so as to output a signal representing the temperature Tw of cooling water within the cylinder block 11.

The cam position sensor 213 is attached to the cylinder head 12. The cam position sensor 213 is configured to output a signal (G2 signal) of a waveform having pulses corresponding to the rotational angle of the above-described unillustrated intake cam shaft (which is included in the intake valve control apparatus 125) for reciprocating the intake valve 123.

The crank position sensor 214 is attached to the cylinder block 11. The crank position sensor 214 is configured so as to output a signal of a waveform having pulses corresponding to the rotational angle of the crankshaft 113.

The air flow meter 215 is attached to the intake passage 13. The air flow meter 215 is configured so as to output a signal representing an intake air flow rate Ga, which is the mass flow per unit time of the intake air flowing through the intake passage 13.

The upstream air-fuel ratio sensor **216*a* and the downstream air-fuel ratio sensor 216*b* are attached to the exhaust passage 14. The upstream air-fuel ratio sensor 216*a* is disposed upstream of the upstream catalytic converter 141 with respect to the flow direction of the exhaust gas. The downstream air-fuel ratio sensor 216*b* is disposed at a position between the upstream catalytic converter 141 and the downstream catalytic converter 142. Each of the upstream air-fuel ratio sensor 216***a* and the downstream air-fuel ratio sensor 216*b* is an oxygen concentration sensor, and is configured so as to output a signal representing the oxygen concentration (air-fuel ratio) of the exhaust gas passing through the exhaust passage 14.

Figure 2:
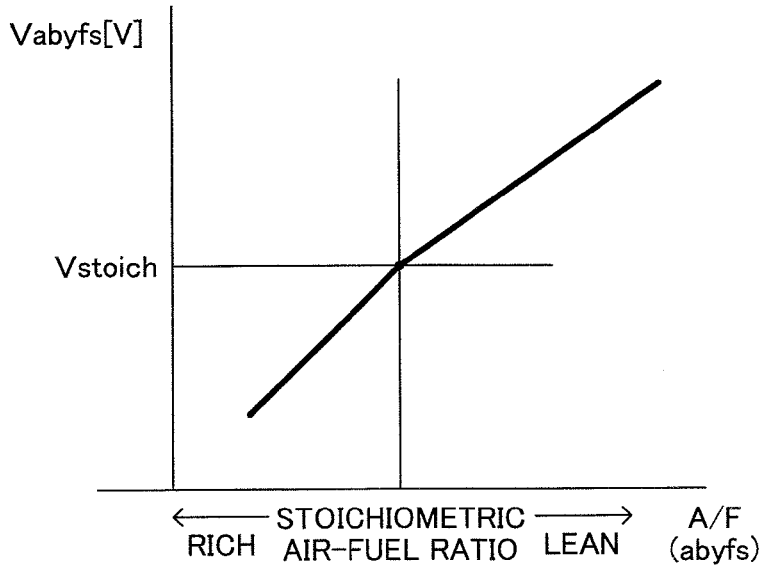
FIG. 2 is a graph representing the relation between the output of the upstream air-fuel ratio sensor shown in FIG. 1 and the air-fuel ratio of exhaust gas.

Specifically, the upstream air-fuel ratio sensor 216*a* is a limiting-current-type oxygen concentration sensor (a so-called A/F sensor), and is configured so as to produce an output which changes substantially linearly with the air-fuel ratio over a wide range as shown in FIG. 2.

Figure 3:
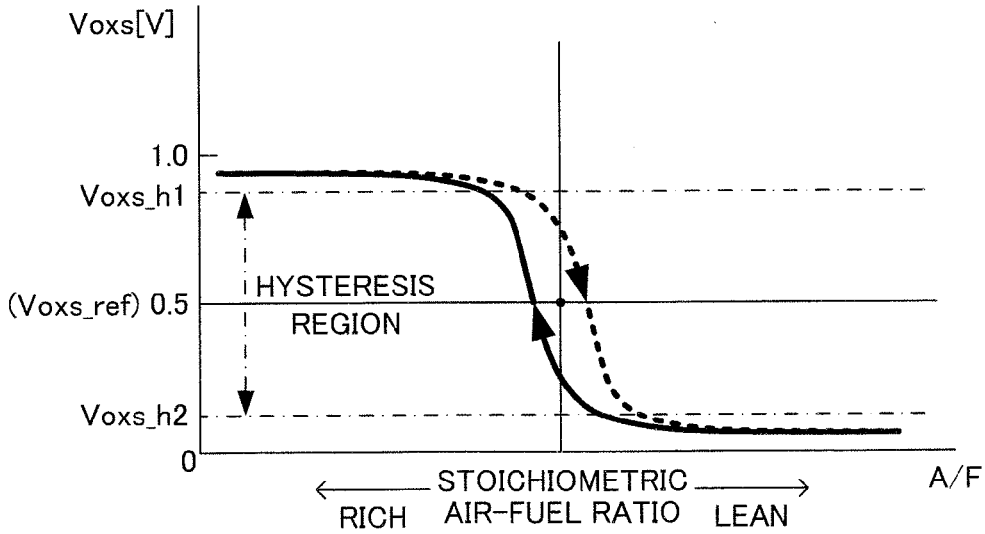
FIG. 3 is a graph representing the relation between the output of the downstream air-fuel ratio sensor shown in FIG. 1 and the air-fuel ratio of exhaust gas.

Meanwhile, the downstream air-fuel ratio sensor 216*b* is an electromotive-force-type (concentration-cell-type) oxygen concentration sensor (a so-called $O_2$ sensor), and is configured so as to produce an output that changes sharply near the stoichiometric air-fuel ratio as shown in FIG. 3. Moreover, the downstream air-fuel ratio sensor 216*b* is configured so as to produce a hysteresis response; that is, the output voltage produced in the case where the air-fuel ratio of exhaust gas changes from the rich side to the lean side while passing through the stoichiometric air-fuel ratio (as indicated by a broken line in FIG. 3) is higher than the output voltage produced in the case where the air-fuel ratio of exhaust gas changes in the opposite direction (as indicated by a solid line in FIG. 3).

The throttle position sensor 217 is disposed at a position corresponding to the position of the throttle valve 132. The throttle position sensor 217 is configured so as to output a signal representing the actual rotational phase of the throttle valve 132 (i.e., throttle valve opening TA).

The accelerator opening sensor 218 is configured so as to output a signal representing an operation amount of an accelerator pedal 220 operated by a driver (accelerator operation amount PA).

<Outline of Operation Realized by Configuration of Embodiment>

The ECU 200 of the present embodiment controls the air-fuel ratio of the engine 1 (i.e., the fuel injection amount (injection period) of the injector 129) on the basis of the outputs from the upstream air-fuel ratio sensor 216*a* and the downstream air-fuel ratio sensor 216*b*.

Specifically, the fuel injection amount is feedback-controlled (main feedback control) on the basis of the output signal from the upstream air-fuel ratio sensor 216*a* in such a manner that the air-fuel ratio of the exhaust gas flowing into the upstream catalytic converter 141 becomes equal to (coincides with) a target air-fuel ratio (requested air-fuel ratio). In addition to the main feedback control, a control for feeding back to the fuel injection amount the output signal of the downstream air-fuel ratio sensor 216*b* (sub-feedback control) is performed. In the sub-feedback control, the air-fuel ratio of the exhaust gas flowing into the upstream catalytic converter 141 (i.e., the air-fuel ratio (requested air-fuel ratio) of the air-fuel mixture supplied to the combustion chamber CC) is determined on the basis of the output signal from the downstream air-fuel ratio sensor 216*b*.

Figure 4:
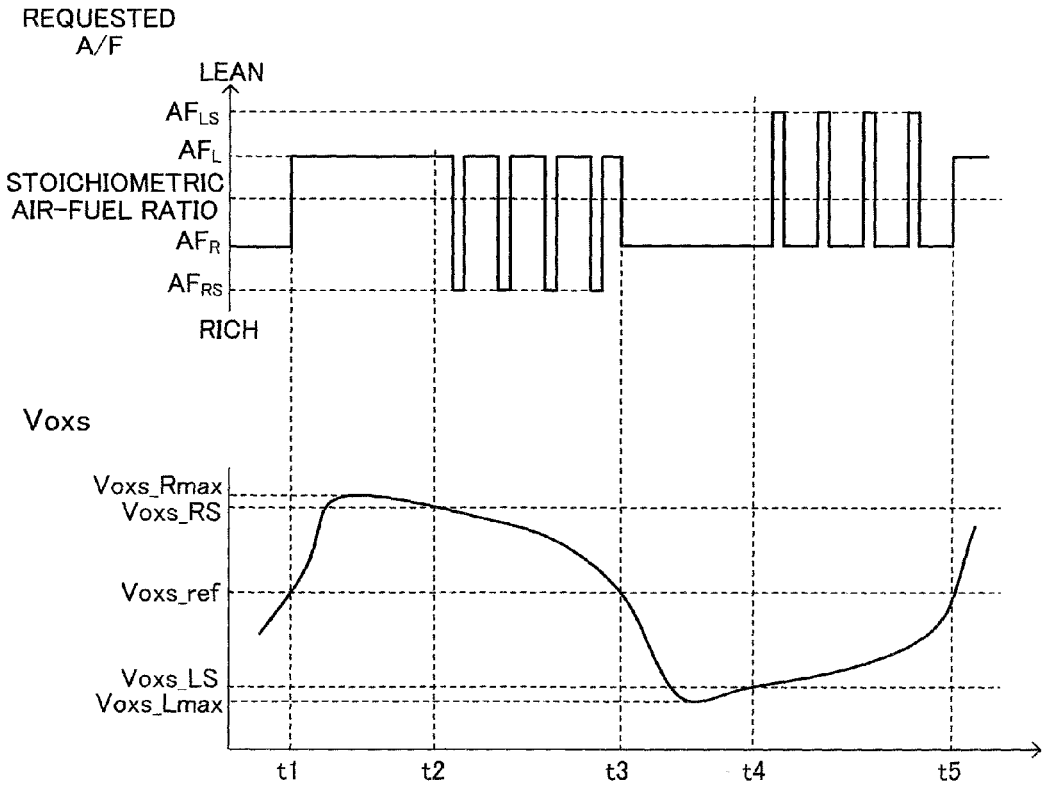
FIG. 4 is a timeline chart showing the details of the control performed in the present embodiment.

FIG. 4 is a timeline chart showing the details of the control performed in the present embodiment.

In FIG. 4, the lower graph titled "Voxs" represents time-course changes in the output Voxs of the downstream air-fuel ratio sensor 216*b*, and the upper graph titled "Requested A/F" represents changes in the requested air-fuel ratio which is set on the basis of the output Voxs (note that a deviation from the "stoichiometric air-fuel ratio" corresponds to the above-described sub-feedback correction amount).

In FIG. 4, before time t1, the output Voxs of the downstream air-fuel ratio sensor 216*b* is on the lean side (i.e., the output Voxs is lower than a target value Voxs_ref corresponding to the stoichiometric air-fuel ratio). Accordingly, before time t1, the requested air-fuel ratio is set to a value on the rich side (rich request) on the basis of the output Voxs of the downstream air-fuel ratio sensor 216*b*.

During execution of an air-fuel ratio correction for the rich request (corresponding to the forward direction correction), an exhaust gas whose air-fuel ratio is on the rich side (hereinafter referred to as "rich exhaust gas") flows into the upstream catalytic converter 141. As a result, in the three-way catalyst provided in the upstream catalytic converter 141 (hereinafter, simply referred to as the "three-way catalyst"), oxygen is released so as to purify (oxidize) the rich exhaust gas. When such oxygen release becomes saturated over the entire three-way catalyst, the rich exhaust gas flows through the upstream catalytic converter 141, whereby the output Voxs of the downstream air-fuel ratio sensor 216*b* changes from the lean side to the rich side.

After time t1 at which the output Voxs of the downstream air-fuel ratio sensor 216*b* changed from the lean side to the rich side, the requested air-fuel ratio is set to a value on the lean side on the basis of the output (lean request: corresponding to the forward direction correction). Immediately after time t1, in the three-way catalyst, oxygen release is substantially saturated as mentioned above. Therefore, if an operation of imparting a rich spike to the requested air-fuel ratio (hereinafter referred to as the "rich spike imparting operation") is performed immediately after the start of the lean request at time t1, it may become difficult to purify (oxidize) rich exhaust gas produced as a result of the rich spike imparting operation.

In order to overcome this difficulty, in the present embodiment, the rich spike imparting operation is in a wait status (prohibited) from time t1 to time t2 at which a predetermined period of time has lapsed since time t1. In the present embodiment, time t2 is a time at which the output (voltage) Voxs of the downstream air-fuel ratio sensor 216*b* has reached a rich spike start value Voxs_RS after having had decreased slightly from a value Voxs_Rmax (a rich-side maximum value or a rich-side extreme value), the value Voxs_Rmax corresponding to the rich-side amplitude of the output Voxs determined by using the target value Voxs_ref corresponding to the stoichiometric air-fuel ratio as the center value.

From time t1 to time t2, the exhaust gas whose air-fuel ratio is on the lean side (hereinafter referred to as "lean exhaust gas") produced as a result of the lean request flows into the three-way catalyst, whereby oxygen storage starts from the upstream end side of the three-way catalyst with respect to the exhaust flow direction. When oxygen storage becomes saturated in the upstream end portion of the three-way catalyst with respect to the exhaust flow direction, the portion where oxygen storage takes place (hereinafter referred to as the "oxygen storage region") moves toward the downstream side. Thus, the oxygen release saturated state is eliminated in successive portions (regions), starting from the upstream end side of the three-way catalyst, thereby allowing treatment of rich exhaust gas produced as a result of the rich spike imparting operation which will be subsequently performed.

Since the rich spike imparting operation is prohibited from time t1 to time t2, the output Voxs of the downstream air-fuel ratio sensor 216*b* can decrease quickly from the rich-side extreme value Voxs_Rmax to reach the rich spike start value Voxs_RS.

When the rich spike imparting operation is permitted, and thus, executed after time t2, the rich exhaust gas produced as a result of the rich spike imparting operation is appropriately treated at the upstream end portion of the three-way catalyst with respect to the exhaust flow direction. Meanwhile, since the average air-fuel ratio of exhaust gas is still on the lean side, the oxygen storage region moves from the middle portion toward the downstream end portion of the three-way catalyst with respect to the exhaust flow direction. Thus, while the change of the output Voxs of the downstream air-fuel ratio sensor 216*b* is moderated (rendered mild) as shown in FIG. 4, the oxygen storage ability of the three-way catalyst is fully utilized. The rich spike imparting operation is permitted until time t3 at which the output Voxs of the downstream air-fuel ratio sensor 216*b* changes from the rich side to the lean side. Notably, the rich spike imparting operation is performed for, for example, 0.1 to 0.5 second each time, and is performed every time a predetermined period of time (1 second to 5 seconds) elapses (a lean spike imparting operation which will be described later is performed in the same manner).

Similarly, when the output Voxs of the downstream air-fuel ratio sensor 216*b* changes from the rich side to the lean side at time t3 as a result of the saturation of oxygen storage in the three-way catalyst, the rich request is started. In this case, the lean spike imparting operation is prohibited until a predetermined period of time elapses from time t3 at which the rich request has started. Thus, an oxygen occludable region which can cope with the lean spike imparting operation performed after time t4 is produced at the upstream end portion of the three-way catalyst with respect to the exhaust flow direction. In addition, the output Voxs of the downstream air-fuel ratio sensor 216*b* can increase quickly from a lean-side extreme value Voxs_Lmax, which will be described later, to reach a lean spike start value Voxs_LS.

After time t4 at which a predetermined period of time has elapsed since time t3, the lean spike imparting operation is permitted. Time t4 is a time at which the output (voltage) Voxs of the downstream air-fuel ratio sensor 216*b* has reached the lean spike start value Voxs_LS after having had increased slightly from the value Voxs_Lmax (the lean-side maximum value or the lean-side extreme value), the value Voxs_Lmax corresponding to the lean-side amplitude of the output Voxs determined by using the target value Voxs_ref corresponding to the stoichiometric air-fuel ratio as the center value. Thus, while the change of the output Voxs of the downstream air-fuel ratio sensor 216*b* is moderated (rendered mild) as shown in FIG. 4, the oxygen release ability of the three-way catalyst is fully utilized. Thereafter, the lean spike imparting operation is permitted until time t5 at which the output Voxs of the downstream air-fuel ratio sensor 216*b* changes from the lean side to the rich side.

In the present embodiment, a requested air-fuel ratio $AF_{RS}$ used in the rich spike imparting operation is set to be on the rich side in relation to (richer than) a requested air-fuel ratio $AF_R$ used in the rich request. Similarly, a requested air-fuel ratio $AF_{LS}$ used in the lean spike imparting operation is set to be on the lean side in relation to (leaner than) a requested air-fuel ratio $AF_L$ used in the lean request.

Moreover, in the present embodiment, the rich spike start value Voxs_RS which determines the range in which the rich spike imparting operation is permitted is set so as to coincide with (be equal to) a voltage Voxs_h1 which determines a "hysteresis region" of the downstream air-fuel ratio sensor 216*b* (see FIG. 3). Similarly, the lean spike start value Voxs_LS which determines the range in which the lean spike imparting operation is permitted is set so as to coincide with (be equal to) a voltage Voxs_h2 which determines the "hysteresis region" of the downstream air-fuel ratio sensor 216*b* (see FIG. 3).

It should be noted that the "hysteresis region" refers to a region in which a large difference in the output voltage occurs for a certain air-fuel ratio of exhaust gas between the case where the changing direction of the air-fuel ratio is from the rich side to the lean side and the case where the changing direction of the air-fuel ratio is from the lean side to the rich side (see the region enclosed by an alternate long and short dash line in FIG. 3). The specific values of Voxs_h1 [V] and Voxs_h2 [V], which determine the range of the "hysteresis region," varies appropriately depending on the output characteristic (shape of the hysteresis curve) of the downstream air-fuel ratio sensor 216*b*.

Specific Example of Operation

Figure 5:
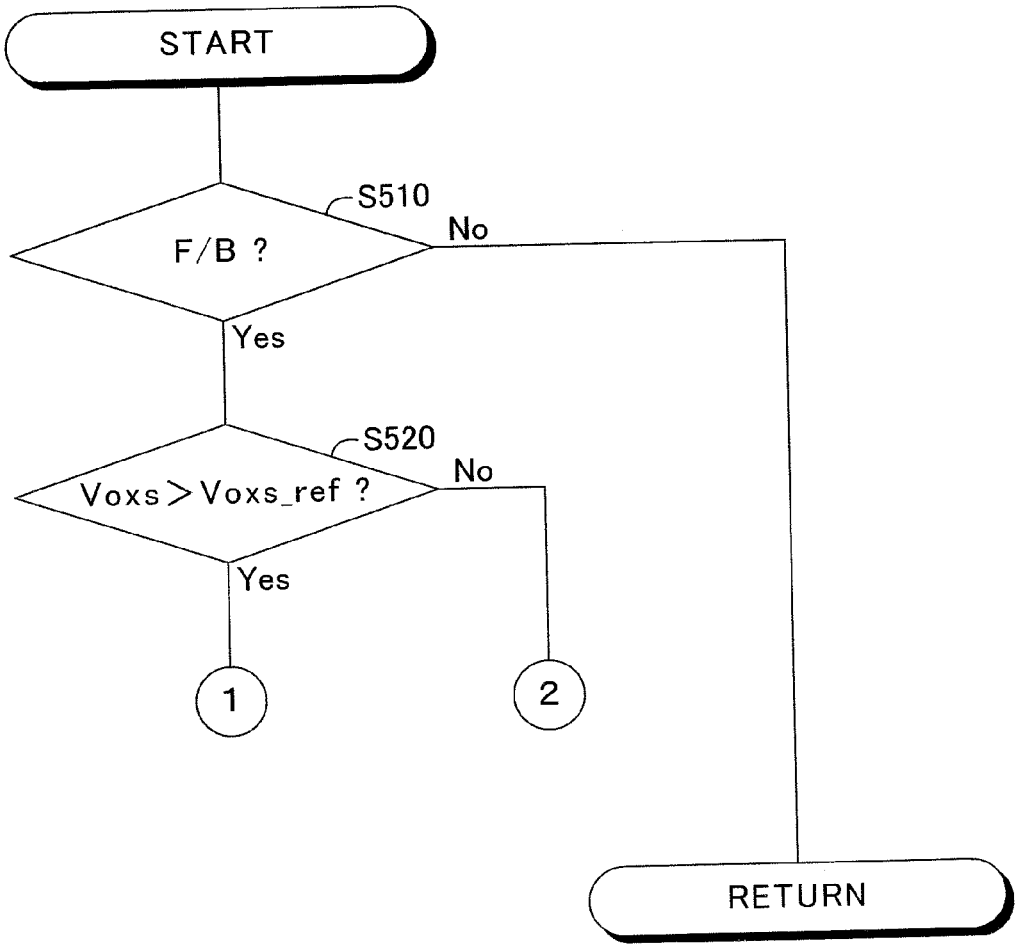
FIG. 5 is a flowchart showing a specific example of the processing performed by the CPU shown in FIG. 1.
Figure 6:
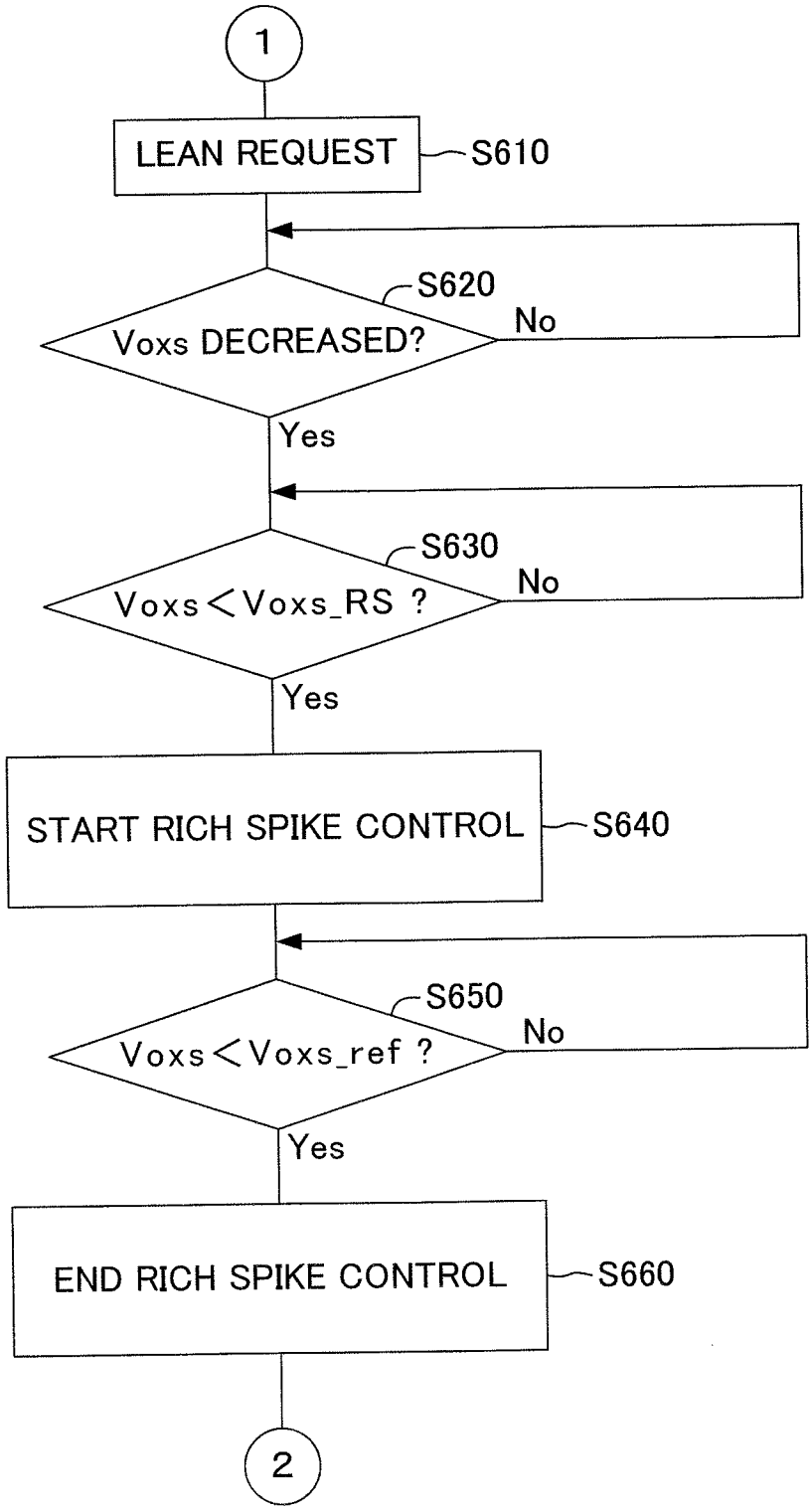
FIG. 6 is a flowchart showing the specific example of the processing performed by the CPU shown in FIG. 1.
Figure 7:
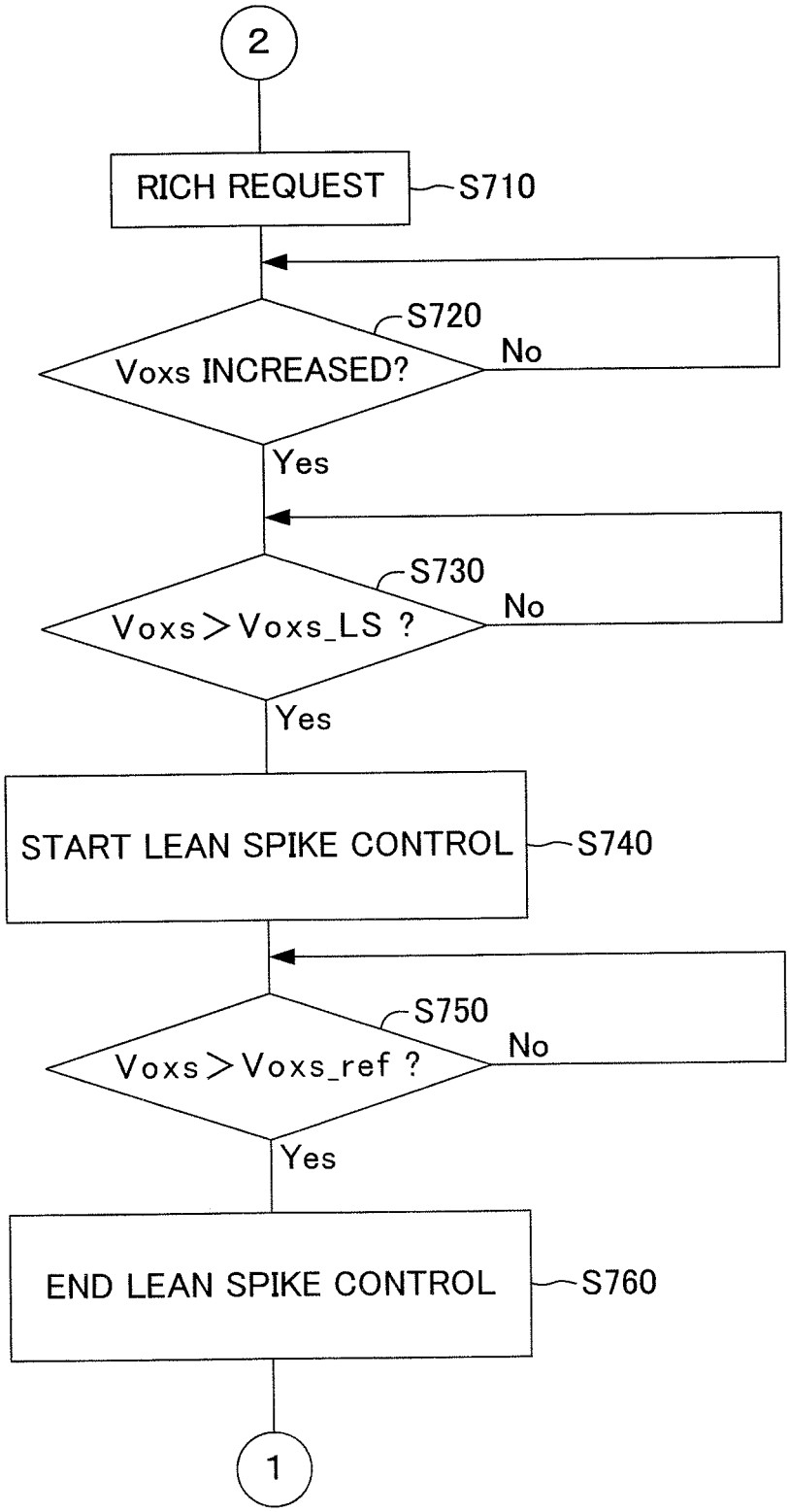
FIG. 7 is a flowchart showing the specific example of the processing performed by the CPU shown in FIG. 1.

FIGS. 5 to 7 are the flowcharts showing a specific example of processing performed by the CPU 201 shown in FIG. 1. Notably, in the flowcharts of FIGS. 5 to 7, a term "step" is abbreviated to "S."

Referring to FIG. 5 first, at Step 510, it is determined whether or not feedback control is currently being performed. If the feedback control is not being performed (Step 510=No), all the remaining steps are skipped. If the feedback control is being performed (Step 510=Yes), the process proceeds to Step 520 at which it is determined whether or not the current output (voltage) Voxs of the downstream air-fuel ratio sensor 216*b* is greater (higher) than the target value Voxs_ref corresponding to the stoichiometric air-fuel ratio.

If the current output Voxs of the downstream air-fuel ratio sensor 216*b* is greater than the target value Voxs_ref corresponding to the stoichiometric air-fuel ratio (Step 520=Yes), the process proceeds to Step 610 of FIG. 6 to start the lean request. Next, the process proceeds to Step 620 at which it is determined whether or not the output Voxs of the downstream air-fuel ratio sensor 216*b* is decreasing. The process does not proceed to the subsequent Step 630 until the output Voxs of the downstream air-fuel ratio sensor 216*b* starts to decrease.

When the output Voxs of the downstream air-fuel ratio sensor 216*b* starts to decrease (Step 620=Yes), it is determined whether or not the current output (voltage) Voxs of the downstream air-fuel ratio sensor 216*b* has become less (lower) than the rich spike start value Voxs_RS (Step 630). Performance of rich spike control is in a wait status (prohibited) until the output Voxs of the downstream air-fuel ratio sensor 216*b* becomes lower than the rich spike start value Voxs_RS (Step 630=No).

When the output Voxs of the downstream air-fuel ratio sensor 216*b* becomes lower than the rich spike start value Voxs_RS (Step 630=Yes), the process proceeds to Step 640 to start (permit) the rich spike control. Thus, as shown in FIG. 4, the rich spike imparting operation is performed appropriately.

Next, it is determined whether or not the current output Voxs of the downstream air-fuel ratio sensor 216*b* has become lower than the target value Voxs_ref corresponding to the stoichiometric air-fuel ratio (Step 650). The rich spike control is permitted until the output Voxs of the downstream air-fuel ratio sensor 216*b* becomes lower than the target value Voxs_ref (Step 650=No). When the output Voxs of the downstream air-fuel ratio sensor 216*b* becomes lower than the target value Voxs_ref (Step 650=Yes), the process proceeds to Step 660 to end the rich spike control.

If the determination at Step 520 of FIG. 5 is no, or if the process has gone through Step 660 of FIG. 6, the process proceeds to Step 710 of FIG. 7 so as to start the rich request. Next, the process proceeds to Step 720 at which it is determined whether or not the output Voxs of the downstream air-fuel ratio sensor 216*b* is increasing. The process does not proceed to the subsequent Step 730 until the output Voxs of the downstream air-fuel ratio sensor 216*b* starts to increase.

When the output Voxs of the downstream air-fuel ratio sensor 216*b* starts to increase (Step 720=Yes), it is determined whether or not the current output Voxs of the downstream air-fuel ratio sensor 216*b* has become greater than the lean spike start value Voxs_LS (Step 730). Performance of the lean spike control is in a wait status (prohibited) until the output Voxs of the downstream air-fuel ratio sensor 216*b* becomes greater than the lean spike start value Voxs_LS (Step 730=No).

When the output Voxs of the downstream air-fuel ratio sensor 216*b* becomes greater than the lean spike start value Voxs_LS (Step 730=Yes), the process proceeds to Step 740 to start (permit) the lean spike control. Thus, as shown in FIG. 4, the lean spike imparting operation is performed appropriately.

Subsequently, it is determined whether or not the current output Voxs of the downstream air-fuel ratio sensor 216*b* has become greater than the target value Voxs_ref corresponding to the stoichiometric air-fuel ratio (Step 750). The lean spike control is permitted until the output Voxs of the downstream air-fuel ratio sensor 216*b* becomes greater than the target value Voxs_ref (Step 750=No). When the output Voxs of the downstream air-fuel ratio sensor 216*b* becomes larger than the target value Voxs_ref (Step 750=Yes), the process proceeds to Step 760 to end the lean spike control. Next, the process proceeds to Step 610 of FIG. 6 to start the lean request.

<Action and Effects Attained by Embodiment>

As mentioned above, in the present embodiment, when the output Voxs of the downstream air-fuel ratio sensor 216*b* changes from the lean side to the rich side, the requested air-fuel ratio is set to a value shifted greatly toward the lean side on the basis of the output Voxs. Similarly, when the output Voxs of the downstream air-fuel ratio sensor 216*b* changes from the rich side to the lean side, the requested air-fuel ratio is set to a value shifted greatly toward the rich side on the basis of the output Voxs. Thus, the speed of storage/occlusion and release of oxygen in the three-way catalyst increases, thereby enhancing the oxygen storage ability of the three-way catalyst.

In the present embodiment, the spikes in a direction opposite to the direction of (toward) the requested air-fuel ratio which is determined on the basis of the output Voxs of the downstream air-fuel ratio sensor 216*b* are introduced when the predetermined period of time elapses after the change of the output between the rich and lean sides.

By virtue of this, the oxygen occlusion ability of the three-way catalyst is fully utilized, and the transitional output (sharp change in output) of the downstream air-fuel ratio sensor 216*b* is suppressed. Further, since the period of time during which the output Voxs of the downstream air-fuel ratio sensor 216*b* is in the vicinity of the extreme value (Voxs_Lmax or Voxs_Rmax) can be shortened to a possible extent, the downstream air-fuel ratio sensor 216*b* can be used in a region where the sensor exhibits satisfactory responsiveness to a possible extent. In particular, as mentioned above, since the output of the downstream air-fuel ratio sensor 216*b* has the hysteresis, the responsiveness of the downstream air-fuel ratio sensor 216*b* worsens when it is exposed to an extremely oxidative or reductive atmosphere. In contrast, according to the present embodiment, such worsening of the responsiveness is suppressed to a possible extent.

As mentioned above, the present embodiment is configured in such a manner that the oxygen storage function of the three-way catalyst can be utilized more effectively and the emission suppression performance is superior as compared with conventional apparatuses of such a type which merely perform a perturbation control. Hence, according to the configuration of the present embodiment, a good responsiveness is ensured for the feedback control.

<Exemplification of Modifications>

The above-described embodiment is, as mentioned previously, a mere example of a typical embodiment of the present invention which the applicant of the present invention considered to be best at the time of filing the present application. Therefore, the present invention is not limited to the above-described embodiment. Various modifications to the above-described embodiment are possible so long as the invention is not modified in essence.

Hereinafter, several typical modifications will be exemplified. Needless to say, even modifications are not limited to those exemplified below. A plurality of modifications can be applied in appropriate combination so long as no technical inconsistencies are involved.

The above-described embodiment and the following modifications should not be construed as limiting the present invention (relating, in particular, to the components which constitute the means for solving the problems to be solved by the invention and are expressed operationally and functionally). Such limiting construal unfairly impairs the interests of an applicant who is motivated to file as quickly as possible under the first-to-file system; unfairly benefits imitators; and is thus impermissible.

(A) The present invention is not limited to the specific apparatus structure disclosed in the above-described embodiment. For example, the present invention can be applied to gasoline engines, diesel engines, methanol engines bio-ethanol engines, and other internal combustion engines of any type. No limitation is imposed on the number of cylinders, the arrangement of cylinders (straight, V-type, horizontally opposed), the fuel supply scheme, and the ignition system.

Together with or in place the injector 129, there may be provided an in-cylinder injection valve for injecting a fuel directly into the combustion chamber CC (refer to, for example, Japanese Patent Application Laid-Open (kokai) No. 2007-278137). The present invention can be favorably applied to such a configuration.

(B) The present invention is not limited to the specific processing disclosed in the above-described embodiment. For example, the operating state parameters acquired (detected) by sensors can be substituted by values which are estimated on the basis of other operating state parameters acquired (detected) by other sensors.

Instead of executing Steps 620 and 630 of FIG. 6, a determination may be made as to whether or not a predetermined period of time has elapsed since the output Voxs of the downstream air-fuel ratio sensor 216*b* changed from the lean side to the rich side. Similarly, instead of executing Steps 720 and 730 of FIG. 7, a determination may be made as to whether or not a predetermined period of time has elapsed since the output Voxs of the downstream air-fuel ratio sensor 216*b* changed from the rich side to the lean side. In addition, a cumulative value of the intake air flow rate Ga calculated after the change of the output between the rich and lean sides can be used to determine whether or not the spike imparting operation is to be started.

Figure 8:
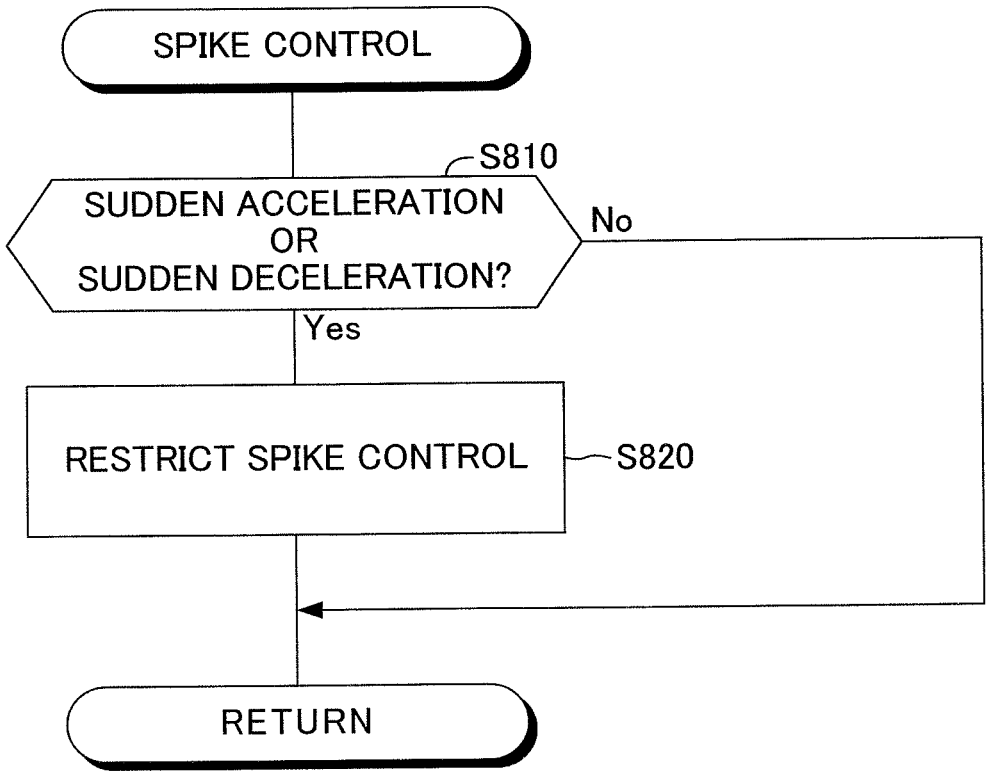
FIG. 8 is a flowchart showing another specific example of the processing performed by the CPU shown in FIG. 1.

In the case of abrupt/sudden acceleration or deceleration, introduction of the rich or lean spikes may be restricted (prohibited or reduced in quantity). FIG. 8 is a flowchart showing the operation in such a modification. As shown in FIG. 8, in the case of the sudden acceleration or deceleration (Step 810=Yes), spike control is restricted at Step 820. Thus, there is satisfactorily suppressed worsening of exhaust emissions, which would otherwise be caused by inadvertent introduction of the rich or lean spike imparting operation.

The requested air-fuel ratio $AF_{RS}$ used in the rich spike imparting operation may be the same as the requested air-fuel ratio $AF_R$ used in the rich request. The requested air-fuel ratio $AF_{LS}$ used in the lean spike imparting operation may be the same as the requested air-fuel ratio $AF_L$ used in the lean request. In other words, $AF_R$ may be set to a value between 13.5 and 14.4; $AF_{RS}$ may be set to a value between 12.5 and 14.2; $AF_L$ may be set to a value between 14.7 and 15; and $AF_{LS}$ may be set to a value between 15 and 17, respectively. These values may be changed appropriately in accordance with the oxygen storage ability of the three-way catalyst (deterioration of the catalyst).

Meanwhile, the rich spike start value Voxs_RS need not coincide with the voltage Voxs_h1 determining the "hysteresis region" of the downstream air-fuel ratio sensor 216*b* (see FIG. 3). Similarly, the lean spike start value Voxs_LS need not coincide with the voltage Voxs_h2 determining the "hysteresis region" of the downstream air-fuel ratio sensor 216*b* (see FIG. 3).

Figure 9:
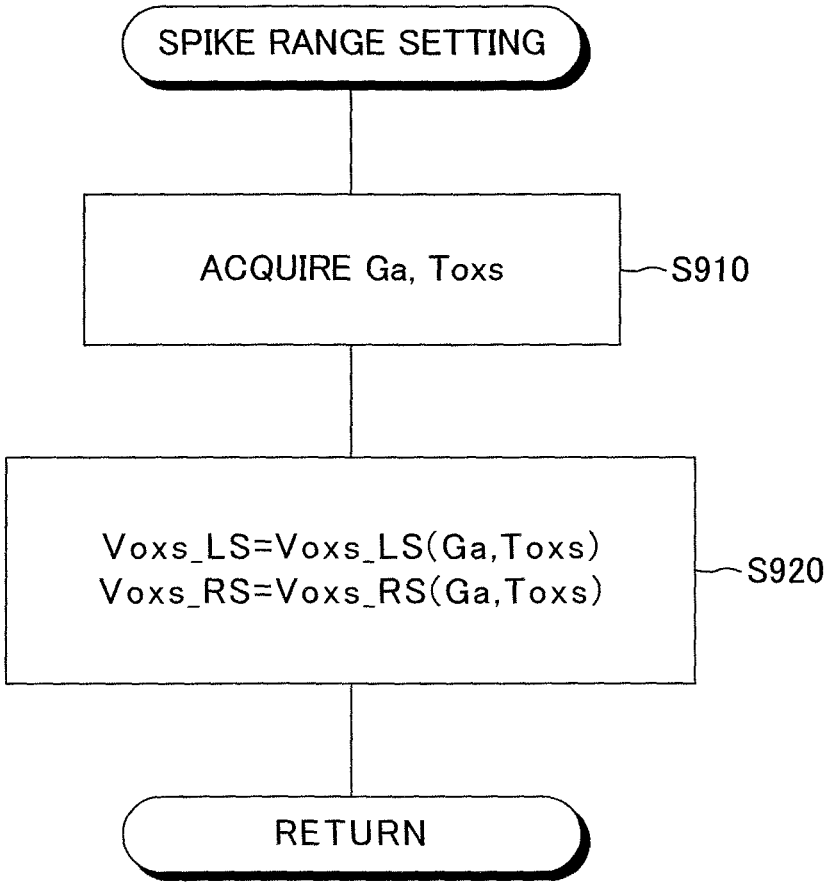
FIG. 9 is a flowchart showing yet another specific example of the processing performed by the CPU shown in FIG. 1.

The rich spike start value Voxs_RS and the lean spike start value Voxs_LS may be changed depending on the operating state. FIG. 9 is a flowchart showing the operation in such a modification.

Referring to FIG. 9, the intake air flow rate Ga and the temperature Toxs of the downstream air-fuel ratio sensor 216*b* are acquired (Step 910). Specifically, as mentioned above, the intake air flow rate Ga is obtained on the basis of the output of the air flow meter 215. The temperature Toxs of the downstream air-fuel ratio sensor 216*b* can be measured directly by use of a thermocouple, etc.

Next, on the basis of the intake air flow rate Ga and the temperature Toxs of the downstream air-fuel ratio sensor 216*b*, the rich spike start value Voxs_RS and the lean spike start value Voxs_LS are obtained with reference to a table (this table is prepared in advance through experiment, etc., and is stored in the ROM 202 or the backup RAM 204). Thus, the rich spike start value Voxs_RS and the lean spike start value Voxs_LS become the values corresponding to the obtained intake air flow rate Ga and the temperature Toxs of the downstream air-fuel ratio sensor 216*b*.

Specifically, the amplitude of the output Voxs of the downstream air-fuel ratio sensor 216*b* becomes smaller as the intake air flow rate Ga becomes larger. Therefore, as the intake air flow rate Ga becomes larger, each of the rich spike start value Voxs_RS and the lean spike start value Voxs_LS is determined so as to become closer to the target value Voxs_ref corresponding to the stoichiometric air-fuel ratio. Similarly, the amplitude of the output Voxs of the downstream air-fuel ratio sensor 216*b* becomes smaller as the temperature Toxs of the downstream air-fuel ratio sensor 216*b* becomes higher. Therefore, as the temperature of the downstream air-fuel ratio sensor 216*b* becomes higher, each of the rich spike start value Voxs_RS and the lean spike start value Voxs_LS is determined so as to become closer to the target value Voxs_ref corresponding to the stoichiometric air-fuel ratio.

As the temperature Toxs of the downstream air-fuel ratio sensor 216*b*, there may be used an exhaust gas temperature which is onboard estimated from the engine speed Ne acquired on the basis of the output of the crank position sensor 214, the engine load KL acquired on the basis of the output of the air flow meter 215, etc. (refer to, for example, Japanese Patent Application Laid-Open (kokai) No. 2009-68398, etc.).

Meanwhile, the rich spike start value Voxs_RS and the lean spike start value Voxs_LS may be obtained on the basis of one of the intake air flow rate Ga and the temperature Toxs of the downstream air-fuel ratio sensor 216*b*. In addition, the rich spike start value Voxs_RS and the lean spike start value Voxs_LS may be obtained on the basis of other operating state parameters (e.g., a catalyst bed temperature (i.e., the temperature of the upstream catalytic converter 141) which is onboard estimated from the intake air flow rate Ga, etc.).

(C) Modifications which are not specifically described herein naturally fall within the scope of the present invention, so long as they do not change the essential portion of the present invention.

Those components which partially constitute the sections/means for solving the problems to be solved by the present invention and are expressed operationally and functionally encompass not only the specific structures disclosed in the above-described embodiment and modifications but also any other structures that can implement the operations and functions of the components. Moreover, descriptions in the patent documents (including specifications and drawings) referred to in this specification are incorporated herein by reference as a portion thereof.

The invention claimed is:

1. An air-fuel ratio control apparatus which controls an air-fuel ratio of an internal combustion engine based on an output of an upstream air-fuel ratio sensor provided in an exhaust passage to be located upstream, with respect to an exhaust gas flow direction, of an exhaust purification catalyst for purifying exhaust gas discharged from cylinders of said engine and based on an output of a downstream air-fuel ratio sensor provided in said exhaust passage to be located downstream of said exhaust purification catalyst with respect to said exhaust gas flow direction, said air-fuel ratio control apparatus being characterized by comprising:

a determination section configured so as to determine whether or not said output of said downstream air-fuel ratio sensor falls within a predetermined range whose center corresponds to a target value corresponding to a stoichiometric air-fuel ratio;

a reverse direction correction introducing section, operable when said output of said downstream air-fuel ratio sensor falls within said predetermined range, configured so as to temporarily introduce an air-fuel ratio correction in a reverse direction opposite to a direction requested by said output, wherein said reverse direction correction introducing section is configured so as to introduce a rich spike in a case where said output of said downstream air-fuel ratio sensor shifts to a rich side so that an air-fuel ratio correction in a lean direction is requested, and so as to introduce a lean spike in a case where said output of said downstream air-fuel ratio sensor shifts to a lean side so that an air-fuel ratio correction in a rich direction is requested; and a fuel injector operable to inject an amount of fuel based on the requested air-fuel ratio correction.

2. The air-fuel ratio control apparatus according to claim 1, wherein said downstream air-fuel ratio sensor is an electromotive-force-type oxygen concentration sensor which exhibits a stepwise response near said stoichiometric air-fuel ratio.

3. The air-fuel ratio control apparatus according to claim 1, further comprising a range changing section configured so as to change said predetermined range depending on an operating state of said internal combustion engine.

4. The air-fuel ratio control apparatus according to claim 3, wherein said downstream air-fuel ratio sensor is an electromotive-force-type oxygen concentration sensor which exhibits a stepwise response near said stoichiometric air-fuel ratio.

5. The air-fuel ratio control apparatus according to claim 1, wherein, said reverse direction correction introducing section is configured so as to restrict said introduction of said air-fuel ratio correction in said reverse direction during a sudden acceleration or a sudden deceleration.

6. The air-fuel ratio control apparatus according to claim 5, wherein said downstream air-fuel ratio sensor is an electromotive-force-type oxygen concentration sensor which exhibits a stepwise response near said stoichiometric air-fuel ratio.

7. The air-fuel ratio control apparatus according to claim 5, further comprising a range changing section configured so as to change said predetermined range depending on an operating state of said internal combustion engine.

8. The air-fuel ratio control apparatus according to claim 7, wherein said downstream air-fuel ratio sensor is an electromotive-force-type oxygen concentration sensor which exhibits a stepwise response near said stoichiometric air-fuel ratio.

9. The air-fuel ratio control apparatus according to claim 1, wherein, said reverse direction correction introducing section is configured so as to prohibit said introduction of said air-fuel ratio correction in said reverse direction until a predetermined period of time elapses after said output of said downstream air-fuel ratio sensor has changed between rich and lean sides, and so as to implement said introduction of said air-fuel ratio correction in said reverse direction after a lapse of said predetermined period of time.

10. The air-fuel ratio control apparatus according to claim 9, wherein said downstream air-fuel ratio sensor is an electromotive-force-type oxygen concentration sensor which exhibits a stepwise response near said stoichiometric air-fuel ratio.

11. The air-fuel ratio control apparatus according to claim 9, further comprising a range changing section configured so as to change said predetermined range depending on an operating state of said internal combustion engine.

12. The air-fuel ratio control apparatus according to claim 11, wherein said downstream air-fuel ratio sensor is an electromotive-force-type oxygen concentration sensor which exhibits a stepwise response near said stoichiometric air-fuel ratio.

13. The air-fuel ratio control apparatus according to claim 9, wherein, said reverse direction correction introducing section is configured so as to restrict said introduction of said air-fuel ratio correction in said reverse direction during a sudden acceleration or a sudden deceleration.

14. The air-fuel ratio control apparatus according to claim 13, wherein said downstream air-fuel ratio sensor is an electromotive-force-type oxygen concentration sensor which exhibits a stepwise response near said stoichiometric air-fuel ratio.

15. The air-fuel ratio control apparatus according to claim 13, further comprising a range changing section configured so as to change said predetermined range depending on an operating state of said internal combustion engine.

16. The air-fuel ratio control apparatus according to claim 15, wherein said downstream air-fuel ratio sensor is an electromotive-force-type oxygen concentration sensor which exhibits a stepwise response near said stoichiometric air-fuel ratio.

* * * * *